US010545447B2

(12) United States Patent
Kitabayashi et al.

(10) Patent No.: US 10,545,447 B2
(45) Date of Patent: Jan. 28, 2020

(54) IMAGE FORMING APPARATUS

(71) Applicant: KYOCERA Document Solutions Inc., Osaka (JP)

(72) Inventors: Yuta Kitabayashi, Osaka (JP); Yoshihiro Yamagishi, Osaka (JP); Kenichi Kasama, Osaka (JP); Koji Uno, Osaka (JP); Nobuyuki Hayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/235,078

(22) Filed: Dec. 28, 2018

(65) Prior Publication Data

US 2019/0265627 A1 Aug. 29, 2019

(30) Foreign Application Priority Data

Feb. 28, 2018 (JP) ..... 2018-034297

(51) Int. Cl.
*G03G 15/20* (2006.01)
*G03G 15/00* (2006.01)

(52) U.S. Cl.
CPC ..... *G03G 15/553* (2013.01); *G03G 15/2064* (2013.01); *G03G 2215/20* (2013.01)

(58) Field of Classification Search
USPC ..... 399/33
See application file for complete search history.

(56) References Cited

U.S. PATENT DOCUMENTS

2015/0168891 A1* 6/2015 Van Herpen ..... G01B 7/085 399/33

FOREIGN PATENT DOCUMENTS

JP 2016-80987 A 5/2016
JP 2016-90830 A 5/2016

* cited by examiner

*Primary Examiner* — Quana Grainger
(74) *Attorney, Agent, or Firm* — Stein IP, LLC

(57) ABSTRACT

An image forming apparatus has an image forming portion, a fixing device, a temperature sensing device, and a control portion. The fixing device has a fixing member having a heated rotary member and a pressing member forming a fixing nip by making contact with the heated rotary member. The temperature sensing device senses the surface temperature of at least one of the heated rotary member and the pressing member in a plurality of regions in the axial direction. The control portion estimates the thickness distribution of the surface layer of at least one of the heated rotary member and the pressing member in the axial direction based on the time taken for the surface temperature in the plurality of regions to reach the predetermined temperature, and thereby estimates the lifetime of at least one of the heated rotary member or the pressing member based on the estimated thickness distribution.

5 Claims, 9 Drawing Sheets

IMAGE FORMING APPARATUS

INCORPORATION BY REFERENCE

This application is based upon and claims the benefit of priority from the corresponding Japanese Patent Application No. 2018-34297 filed on Feb. 28, 2018, the entire contents of which are incorporated herein by reference.

BACKGROUND

The present disclosure relates to an image forming apparatus, such as a copier or a printer, provided with a fixing device which fixes a toner image having been transferred to a recording medium. More particularly, the present disclosure relates to a method for estimating the lifetime of a fixing member such as a fixing roller or a pressing roller.

In conventional image forming apparatuses utilizing electrophotography, an image forming process proceeds as follows. An image carrying member such as a photosensitive drum having been electrostatically charged uniformly by a charging device is irradiated with laser light from an exposing device to from a predetermined electrostatic latent image with partially attenuated electrostatic charge, and toner is attached to the electrostatic latent image by a developing device to form a toner image. Then, the toner image is transferred to a sheet (recording medium) with a transferring means, and unfixed toner is heated and pressed by a fixing device to form a permanent image.

The fixing device is a device which, while conveying a sheet, melts toner with a fixing member composed of a heated rotary member, such as a fixing roller or a fixing belt, and a pressing member, such as a pressing roller. The worn state of the surface of the fixing member changes depending on the driving time and the number of sheets passed. Continuous use of the fixing member after it has reached the end of its useful life causes image defects and fixing failure.

Thus, to maintain stable image quality over a long period of time, it is necessary to accurately sense the surface condition of the fixing member including a heated rotary member and a pressing member, and to accurately estimate its lifetime. Specifically, since the degree of wear varies in the axial direction, for example, with the size of sheets fed, it is necessary to accurately sense the surface condition of the heated member and the pressing roller.

Accordingly, various methods have been proposed for estimating the lifetime of the fixing device; for example, an image forming apparatus is known which includes a temperature sensing means for sensing the temperature of the fixing device, a counting means for counting the time taken for a recording material of a given size to pass through the fixing device, and a control means for judging the lifetime of the fixing member based on the temperature sensed by the temperature sensing means and the time counted by the counting means.

Also an image forming apparatus is known in which the number of times that it has started up from a state equal to or lower than a predetermined temperature is recorded, and according to the number of times, the condition of the fixing device is estimated, and thereby the temperature of the fixing device is controlled so as to reduce wear of the fixing device while reducing power consumption.

SUMMARY

According to one aspect of the present disclosure, an image forming apparatus includes an image forming portion, a fixing device, a temperature sensing device, and a control portion. The image forming portion forms a toner image on a recording medium. The fixing device has a fixing member including a heated rotary member which is arranged downstream of the image forming portion in the conveyance direction of the recording medium and which is heated by a heating device, and a pressing member which forms a fixing nip by making contact with the heated rotary member. The fixing device heats and presses the recording medium passing through the fixing nip and thereby fixes the toner image to the recording medium. The temperature sensing device senses the surface temperature of at least one of the heated rotary member and the pressing member in a plurality of regions in its axial direction. The control portion estimates the thickness distribution of a surface layer of at least one of the heated rotary member and the pressing member in the axial direction based on the time taken for the surface temperature in the plurality of regions to reach a predetermined temperature and which thereby estimates the lifetime of at least one of the heated rotary member and the pressing member based on the estimated thickness distribution.

Further features and advantages of the present disclosure will become apparent from the description of embodiments given below.

DETAILED DESCRIPTION

Figure 1:
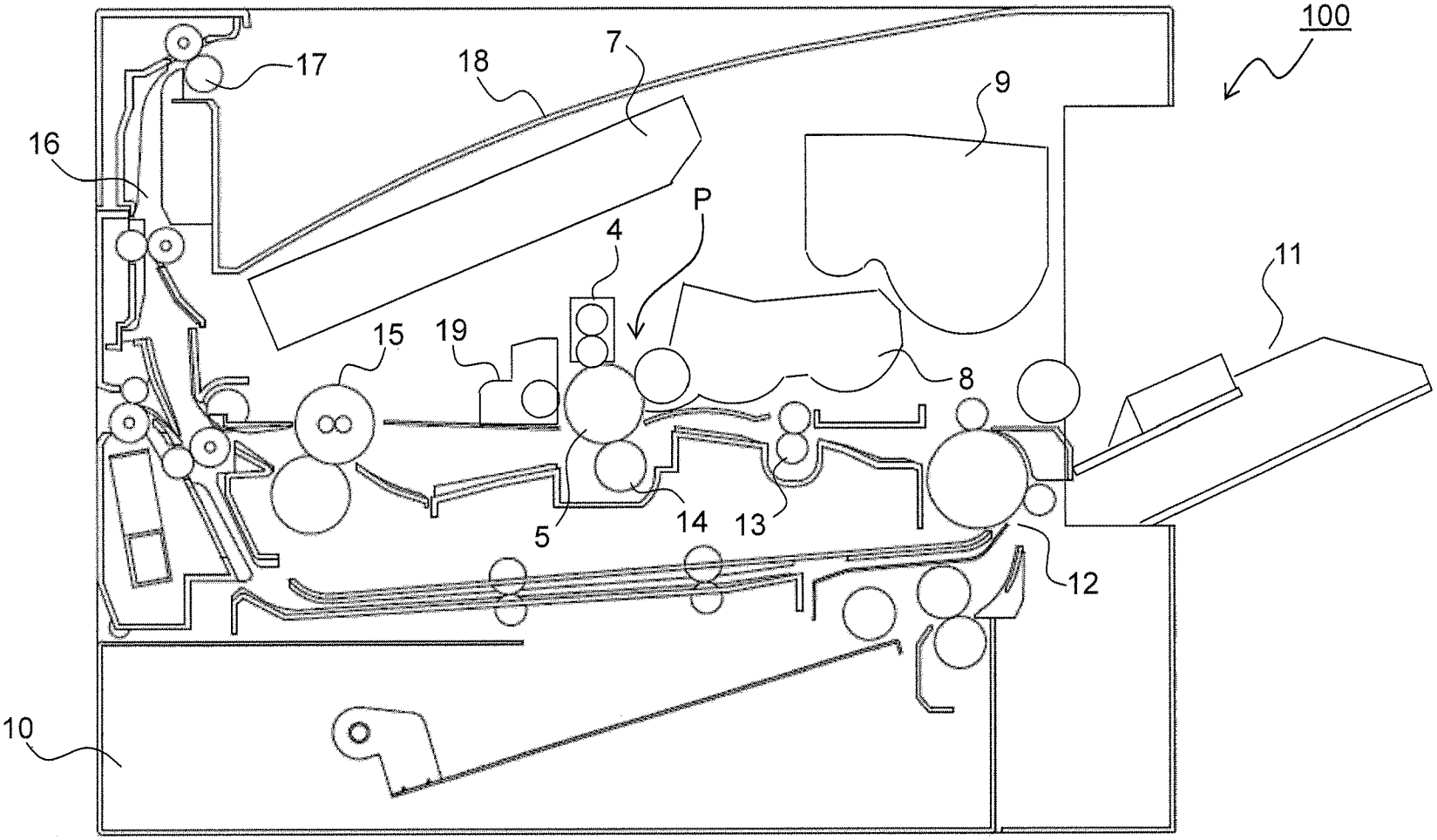
FIG. 1 is a side sectional view of an image forming apparatus according to one embodiment of the present disclosure.

Hereinafter, an embodiment of the present disclosure will be described with reference to the accompanying drawings. FIG. 1 is a side sectional view of an image forming apparatus 100 according to one embodiment of the present disclosure. Inside the image forming apparatus (for example, a monochrome printer) 100, an image forming portion P is arranged which forms a monochrome image through the processes of electrostatic charging, exposure to light, image development, and image transfer. In the image forming portion P, there are arranged, along the rotation direction of a photosensitive drum 5 (the clockwise direction in FIG. 1), a charging device 4, an exposing device (such as a laser scanning unit) 7, a developing device 8, a transfer roller 14, and a cleaning device 19.

When image formation is performed, the surface of the photosensitive drum 5 that rotates in the clockwise direction is electrostatically charged uniformly by the charging device 4. Then, an electrostatic latent image is formed on the photosensitive drum 5 by a laser beam from the exposing device 7 based on document image data, and then, developer (hereinafter, referred to as toner) is attached to the electrostatic latent image by the developing device 8, and thereby a toner image is formed. Toner is fed to the developing device 8 from a toner container 9. The image data is transmitted from a personal computer (unillustrated) or the like. On the downstream side of the cleaning device 19 in the rotation direction of the photosensitive drum 5, there is arranged a destaticizer (unillustrated) that removes electric charge remaining on the surface of the photosensitive drum 5.

Toward the photosensitive drum 5 having the toner image formed on it as described above, a sheet is conveyed from a sheet feed cassette 10 or a manual sheet tray 11 via a sheet conveyance passage 12 and a registration roller pair 13. Then, the toner image formed on the surface of the photosensitive drum 5 is transferred to the sheet by the transfer roller 14 (image transfer portion). Then, the sheet to which the toner image has been transferred is separated from the photosensitive drum 5, and is conveyed to a fixing device 15, where the toner image is fixed. The sheet which has passed through the fixing device 15 is conveyed to an upper part in the image forming apparatus 100 through a sheet conveyance passage 16, and is discharged onto a discharge tray 18 by a discharge roller pair 17.

Figure 2:
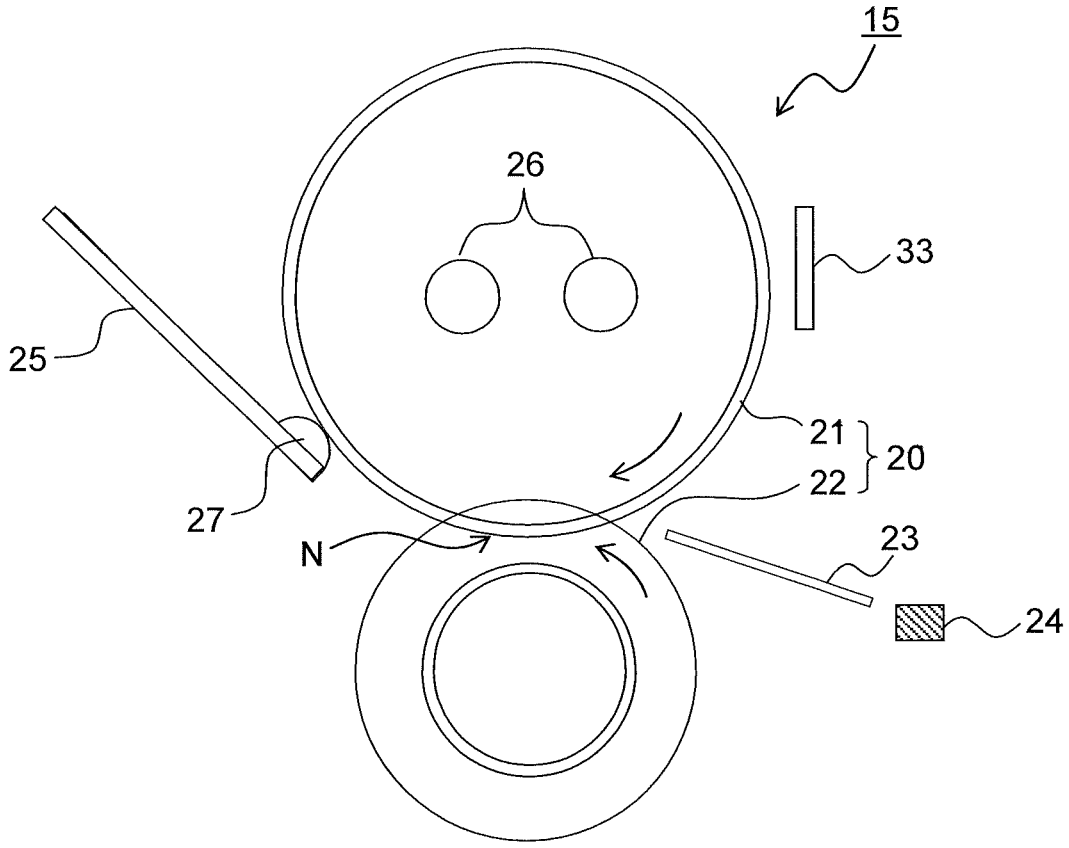
FIG. 2 is a side sectional view of a fixing device incorporated in the image forming apparatus.

FIG. 2 is a side sectional view of the fixing device 15 incorporated in the image forming apparatus 100 in FIG. 1. The fixing device 15 includes a fixing roller pair 20, a fixing entrance guide 23, a sheet detecting sensor 24, a separation plate 25, and a first temperature sensor 33. In FIG. 2, the housing of the fixing device 15 is omitted from illustration.

The fixing roller pair 20 is composed of a fixing roller 21 (heated rotary member) that rotates in the clockwise direction in FIG. 2 by the action of a driving motor (unillustrated) and a pressing roller 22 (pressing member) that rotates in the counter-clockwise direction by following the fixing roller 21 as it rotates. The pressing roller 22 is kept in pressed contact with the fixing roller 21 under a predetermined pressure by an unillustrated biasing means, and thereby forms a fixing nip N. The fixing roller pair 20 fixes unfixed toner to the sheet passing through the fixing nip N.

Figure 3:
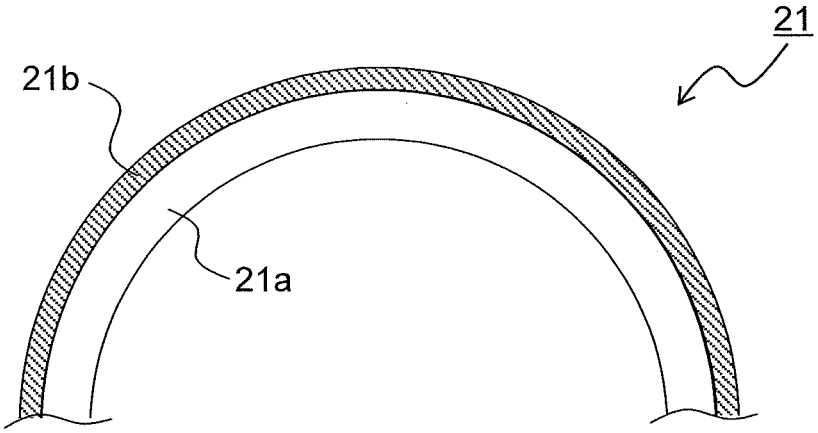
FIG. 3 is a partial sectional view of a fixing roller used in the fixing device.
Figure 4:
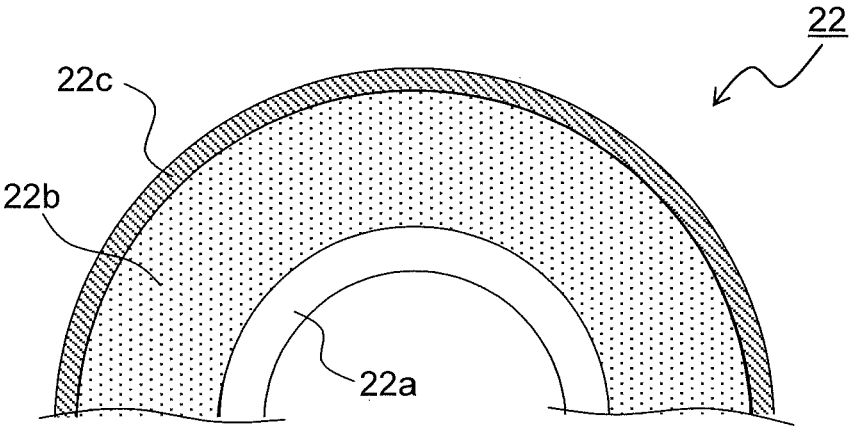
FIG. 4 is a partial sectional view of a pressing roller used in the fixing device.

The fixing roller 21 used in this embodiment adopts, for example, as shown in FIG. 3, a structure in which, on the circumferential surface of a base member 21*a* formed as a cylindrical stainless steel member, a coat layer (release layer) 21*b* of PFA resin (tetrafluoroethylene-perfluoro alkyl vinyl ether copolymer) is laid as a surface layer. The pressing roller 22 adopts, for example, as shown in FIG. 4, a structure in which a metal core 22*a* of aluminum is laid with a silicon rubber layer (elastic layer) 22*b*, and is then coated with a PFA tube (release layer) 22*c*.

The fixing roller 21 incorporates a heater 26. In this embodiment, the heater 26 is a halogen heater. Here, a configuration may be adopted in which the fixing roller 21 is heated from outside with, in place of the heater 26, an IH heater provided with an induction heating portion including an exciting coil and a core.

On the upstream side of the fixing nip N in the sheet conveyance direction (the direction from right to left in FIG. 2), the fixing entrance guide 23 is provided for guiding a sheet to the fixing nip N. Close to the fixing entrance guide 23, on its upstream side, the sheet detecting sensor 24 is arranged which detects the passage of a leading end part and a trailing end part of a sheet. The sheet detecting sensor 24 includes, for example, a fixing actuator which protrudes into the sheet conveyance passage and swings when a sheet passes therethrough, and a PI (photointerrupter) sensor which is turned on or off as the fixing actuator swings.

On the downstream side of the fixing nip N in the rotation direction of the fixing roller 21 (the clockwise direction), the separation plate 25 is arranged which separates the sheet from the fixing roller 21. The separation plate 25 is a plate-form member extending in the width direction of the fixing roller 21 (the direction perpendicular to the plane of FIG. 2), and, separates the sheet having been subjected to fixing from the surface of the fixing roller 21.

To opposite edges of the separation plate 25 in the width direction (the direction perpendicular to the plane of FIG. 2) in an upstream-side end part (the lower right end part in FIG. 2) of the separation plate 25 with respect to the sheet conveyance direction, a pair of clearance restricting members 27 are fixed respectively. The clearance restricting members 27 make contact with opposite end parts, in the axial direction, of the circumferential surface of the fixing roller 21, and thereby the clearance between the upstream-side end parts of the separation plate 25 and the surface of the fixing roller 21 is set to a predetermined clearance.

The sheet having the toner image transferred to it by the transfer roller 14 (see FIG. 1) travels leftward in FIG. 2, is then conveyed through an upstream-side opening in the housing into the fixing device 15, and is then guided along the fixing entrance guide 23 to the fixing nip N between the fixing roller pair 20. When the sheet passes through the fixing nip N, the toner image on the sheet is heated and pressed under a predetermined temperature and pressure, and thereby becomes a permanent image. Then, the sheet is separated from the fixing roller 21 by the separation plate 25, is then conveyed out of the fixing device 15 through a downstream-side opening in the housing, and is then discharged out of the image forming apparatus 100 via the discharge roller pair 17 (see FIG. 1).

On the upstream side of the fixing nip N in the rotation direction of the fixing roller 21, the first temperature sensor 33 is arranged which comprises a thermistor or the like. The first temperature sensor 33 senses the surface temperature of the fixing roller 21 on a non-contact basis.

Figure 5:
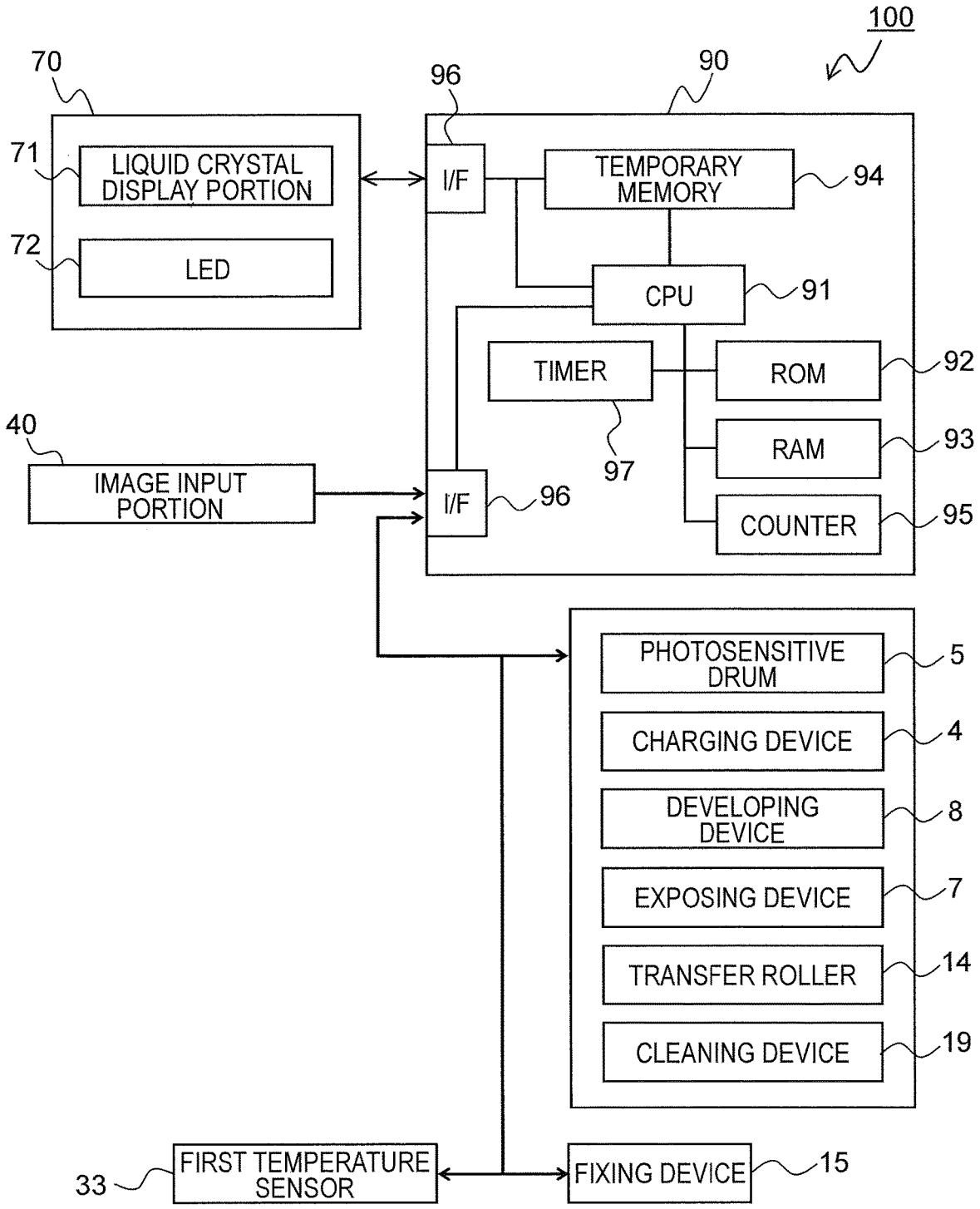
FIG. 5 is a block diagram showing one example of controlling paths in the image forming apparatus.

The result of sensing by the first temperature sensor 33 is transmitted to a control portion 90 (see FIG. 5). Then, a control signal is transmitted from the control portion 90 based on the result of sensing by the first temperature sensor 33 to turn on and off a current passing through the heater 26, and thereby the fixing temperature is controlled. Based on the result of sensing by the first temperature sensor 33, the worn state of the surface of the fixing roller 21 is estimated as will be described later.

FIG. 5 is a block diagram showing controlling paths in the image forming apparatus 100. During the use of the image forming apparatus 100, different blocks of the apparatus are controlled in various manners, and this complicates the controlling paths in the entire image forming apparatus 100. Thus, the following description focuses on only those controlling paths that are relevant to the embodiment of the present disclosure.

An image input portion 40 is a receiving portion which receives image data transmitted from a personal computer or the like to the image forming apparatus 100. The image signal fed in from the image input portion 40 is converted into a digital signal, and is then fed out to a temporary memory 94.

An operation portion 70 includes a liquid crystal display portion 71 and LEDs 72 which show various statuses, and indicates the status of the image forming apparatus 100 and displays the status of image formation and the number of print copies. Various settings for the image forming apparatus 100 are made via the printer driver of a personal computer.

The control portion 90 includes at least a CPU (central processing unit) 91 which serves as a central calculation processing device, ROM (read-only memory) 92 which is a memory for reading only, RAM (random-access memory) 93 which is a memory for both reading and writing can be read and written, a temporary memory 94 which temporarily stores image data or the like, a counter 95, a timer 97, a plurality of (here two) I/Fs (interfaces) 96 which transmit a control signal to different devices in the image forming apparatus 100 and which receive an input signal from the operation portion 70.

The ROM 92 stores programs for controlling the image forming apparatus 100 and data that is not changed during the use of the image forming apparatus 100, such as numerical values necessary for control, and the like. The RAM 93 stores necessary data produced in the process of controlling the image forming apparatus 100, data needed temporarily to control the image forming apparatus 100, and the like.

The temporary memory 94 temporarily stores an image signal which is fed in from the image input portion 40 and then converted into a digital signal. The counter 95 counts the number of printed sheets on a cumulative basis. The timer 97 counts the time taken for the surface temperature of the fixing roller 21 and the pressing roller 22 to reach a predetermined temperature.

As mentioned above, inconveniently, image degradation is more likely to occur when the release layer formed on the surface of the fixing roller 21 wears. Specifically, when the coat layer 21*b* of the fixing roller 21 wears due to friction with a sheet passing through the fixing nip N, melted toner resulting from unfixed toner on the sheet being melted is more likely to attach to the surface of the fixing roller 21. As a result, the sheet sticks to the fixing roller 21, and this causes a jam. The melted toner attached to the fixing roller 21 attaches back to the image side of the next sheet, and this results in soil on the image.

Thus, in the fixing device 15 of the present disclosure, the worn state of the surface of the fixing roller 21 is estimated based on the time (the rate of temperature rise) taken for the surface temperature of the fixing roller 21 to reach a predetermined temperature. Now, a description will be given of a method for estimating the worn state of the surface of the fixing roller 21.

Figure 6:
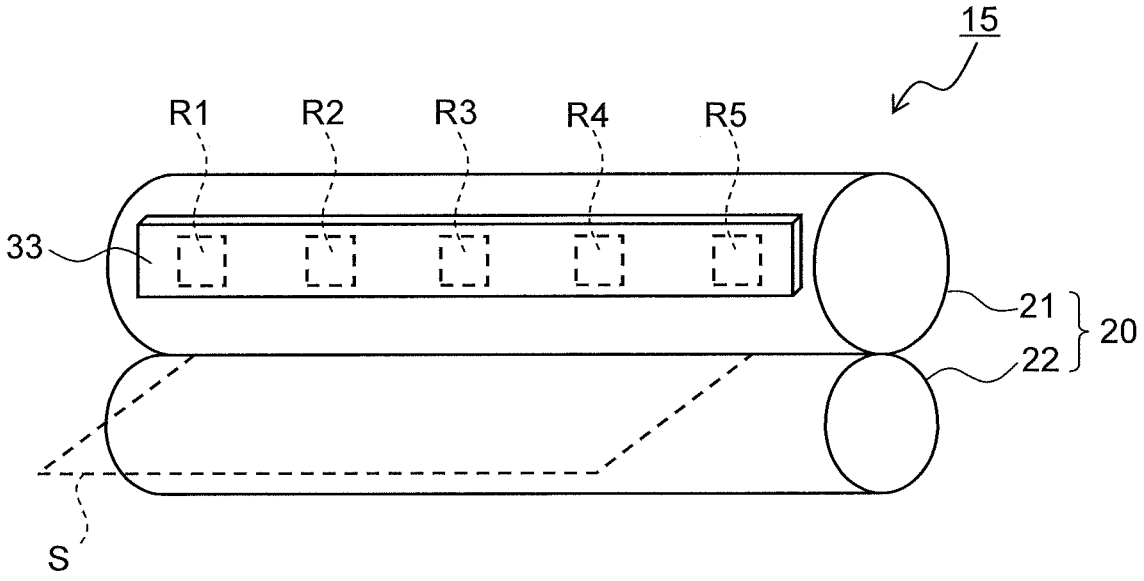
FIG. 6 is a perspective view showing an arrangement of a first temperature sensor with respect to a fixing roller pair.

Specifically, as shown in FIG. 6, at a plurality of places (here, five places, namely regions R1 to R5) on the fixing roller 21 in its axial direction, the first temperature sensor 33 continuously measures the surface temperature, and the timer 97 counts the time (target temperature reaching time) taken for the surface temperature in the regions R1 to R5 to reach the predetermined temperature (target temperature).

Figure 7:
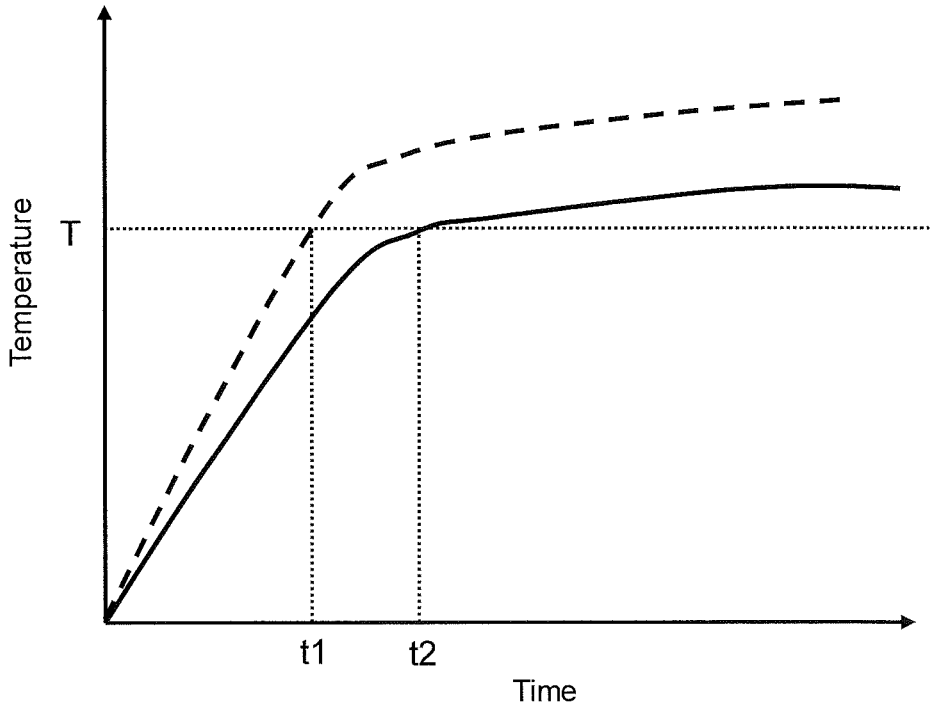
FIG. 7 is a diagram showing a correlation between the time and the surface temperature observed as the heater heats the fixing roller in regions where the degree of wear on the surface of the fixing roller is large and small.

FIG. 7 is a diagram comparing, between regions where the degree of wear on the surface of the fixing roller 21 is large and small, the correlation between the time and the surface temperature observed as the heater 26 heats the fixing roller 21. In a region (the broken-line in FIG. 7) where the degree of wear of the coat layer 21*b* around the surface of the fixing roller 21 is large, the coat layer 21*b* has a lower heat capacity. Thus, time t1 taken to reach a target temperature T in the region where the degree of wear of the coat layer 21*b* is large is shorter than time t2 taken to reach the target temperature T in a region (the solid line in FIG. 7) where the degree of wear of the coat layer 21*b* is small.

Figure 8:
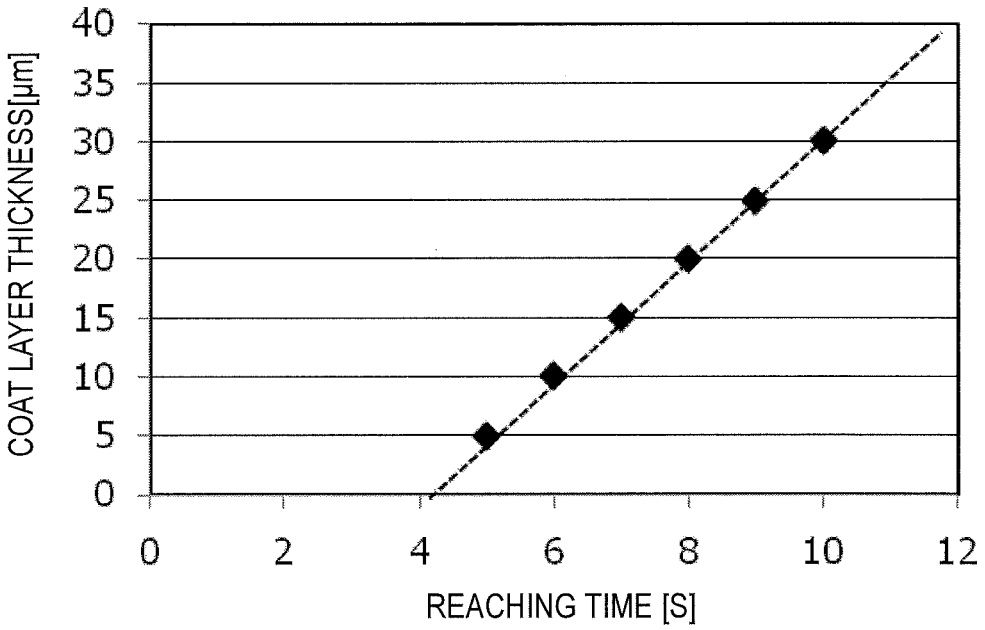
FIG. 8 is a diagram showing a correlation between the time taken for the surface of the fixing roller to reach a target temperature and the thickness of a coat layer.

FIG. 8 is a diagram showing the correlation between the time taken for the surface of the fixing roller 21 to reach the target temperature and the thickness of the coat layer 21*b*. As shown in FIG. 8, the target temperature reaching time and the thickness of the coat layer 21*b* correlate with each other, and thus the thickness of the coat layer 21*b* can be estimated based on the target temperature reaching time.

Thus, by previously storing in the RAM 93 (or the ROM 92) the correlation between the target temperature reaching time and the thickness of the coat layer 21*b* shown in FIG. 8 and comparing the target temperature reaching time counted by the timer 97 among the regions R1 to R5, it is possible to estimate the thickness distribution of the coat layer 21*b* in the axial direction of the fixing roller 21.

Figure 9:
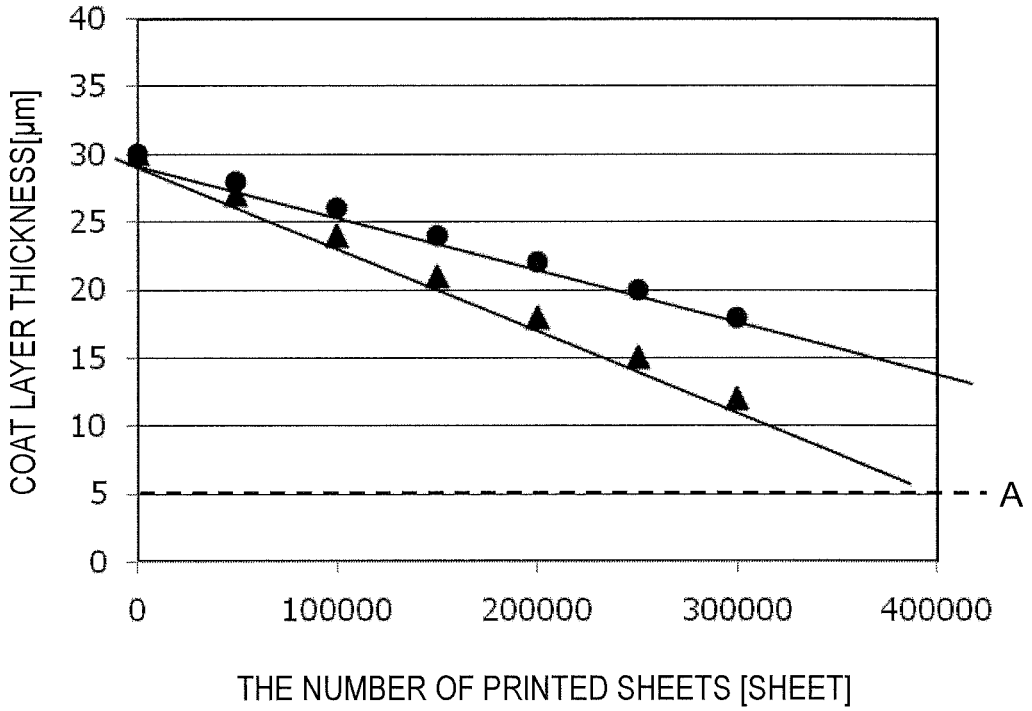
FIG. 9 is a diagram showing a correlation between the cumulative number of printed sheets and the thickness of the coat layer of the fixing roller as observed in the regions R1 and R2 in FIG. 6.

FIG. 9 is a diagram showing the correlation between the cumulative number of printed sheets and the thickness of the coat layer 21*b* of the fixing roller 21 as observed in the regions R1 and R2 in FIG. 6. In FIG. 9, it is assumed that the thickness of the coat layer 21*b* decreases due to friction with sheets used in printing, and when the thickness of the coat layer 21*b* decreases to a given value A (for example, 5 μm), image quality degradation occurs; it is then necessary to replace the fixing roller 21.

The region R1 near an end part of the fixing roller 21 in its axial direction is, as shown in FIG. 6, a region where the passage frequency of an edge part of sheets S in the width direction is high and thus wear progresses quickly. Thus, when the same number of sheets are printed, the thickness of the coat layer in the region R1 (data series indicated by solid triangular symbols in FIG. 9) decreases more than the thickness of the coat layer in the region R2 (data series indicated by solid circular symbols in FIG. 9) where the passage frequency of an edge part of sheets S in the width direction is low and thus wear progresses slowly.

With the conventional method, it is impossible to accurately measure the thickness distribution of the coat layer 21*b* at different parts of the fixing roller 21 in its axial direction, and thus to accurately estimate the lifetime of the fixing roller 21. For example, when only a part in which wear is mild is measured, it can be determined that the fixing roller 21 has not yet reached the end of its useful life; this inconveniently permits printing to be performed with low image quality. If, assuming heavy wear, the lifetime of the fixing roller 21 is previously set short to prevent image quality degradation, the fixing roller 21 may be replaced unnecessarily.

With this embodiment, based on the time taken for the temperature to rise to the target temperature at a plurality of places on the fixing roller 21 in its axial direction, it is possible to accurately estimate the thickness distribution of the coat layer 21*b* in the axial direction. Thus, there is no need to take measures such as to previously set the lifetime of the fixing roller 21 short assuming use of paper with a coarse surface; this makes it possible to appropriately set, according to the manner of use by the user, the number of sheets corresponding to the lifetime.

It is possible to estimate, when printing is continuously performed, an approximate number of sheets printed before the image quality starts to degrade, not by calculating the lifetime from the fixing temperature and the sheet passage time alone as in the conventional method, but based on the thickness of the coat layer 21*b* varied with increase in the cumulative number of printed sheets shown in FIG. 9; thus, it is possible to accurately estimate the lifetime of the fixing roller 21.

The fixing roller 21 sometimes has uneven thickness in its circumferential direction depending on the conditions under which the fixing roller 21 is manufactured, that is, the conditions under which the coat layer 21*b* is deposited. Thus, when the temperature in the regions R1 to R5 in the axial direction is measured and in addition the thickness distribution and thickness variation of the coat layer 21*b* in the axial direction are estimated based on the measured temperature, if the temperature of the fixing roller 21 is measured at different positions in the circumferential direction, the results of temperature measurement may differ at different positions due to the influence of thickness unevenness ascribable to manufacturing; this may inconveniently degrade the estimation accuracy of the thickness distribution and thickness variation.

Thus, the first temperature sensor 33 measures the temperature of the fixing roller 21 always at the same position in the circumferential direction of the fixing roller 21; this makes it possible to improve the estimation accuracy of the thickness distribution and thickness variation. One method for measuring the fixing roller 21 at the same position in the circumferential direction is putting a mark on the circumferential surface of the fixing roller 21 and measuring the temperature with timing with which the marked position is sensed by a reflection-type PI (photointerrupter) sensor or the like.

Figure 10:
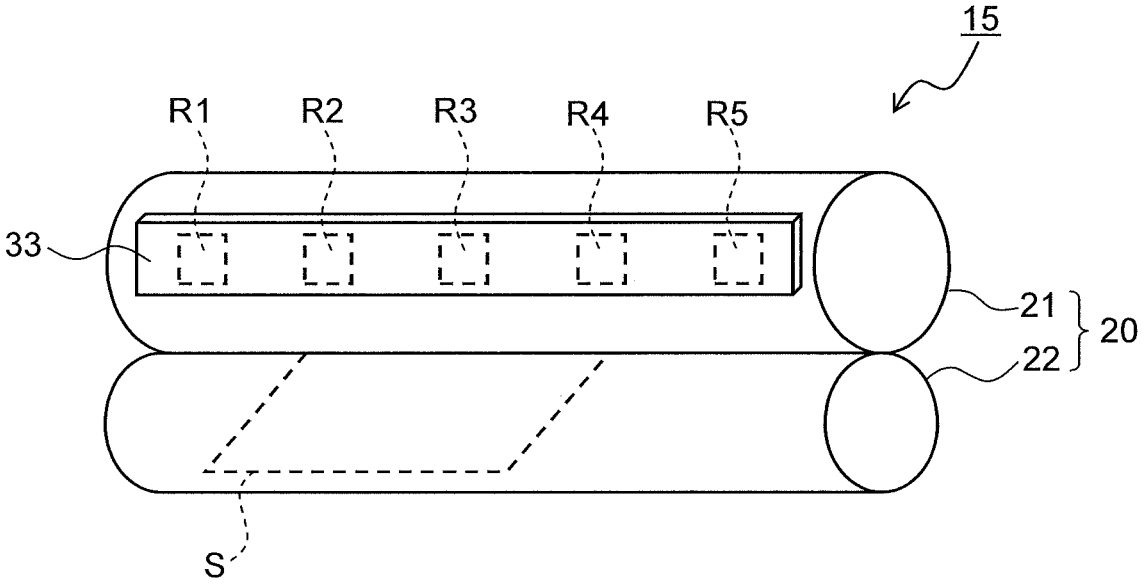
FIG. 10 is a perspective view showing a state where the feed orientation of sheets with respect to the fixing roller pair is portrait.

When the thickness in the regions R1 and R5 where the passage frequency of an edge part of sheets S is high and thus wear on the coat layer 21*b* progresses quickly is equal to or lower than a given value, it is preferable to give a notification that prompts changing of the feed orientation of sheets S, specifically, from landscape orientation feeding (see FIG. 6) to portrait orientation feeding as shown in FIG. 10. This changes the passage position of an edge part of sheets from the regions R1 and R5 to the regions R2 and R4, and thus makes it possible to reduce the degree of wear in the regions R1 and R5 and thus to prolong the lifetime of the fixing roller 21.

On the other hand, when the regular feed orientation of sheets S is portrait orientation feeding as shown in FIG. 10, the passage frequency of an edge part of sheets is high and thus wear in the regions R2 and R4 progresses quickly. Thus, when the thickness in the regions R2 and R4 is equal to or smaller than a given value, a notification can be given that prompts changing of the feed orientation of sheets S to landscape orientation feeding, specifically, to as shown in FIG. 6. In the image forming apparatus 100, the sheet feed orientation can be changed between portrait and landscape only with sheet sizes smaller than the largest sheet size with which portrait orientation feeding is possible. For example, when the largest sheet size with which portrait orientation feeding is possible is A3, the sheet feed orientation can be changed between portrait and landscape only with sheet sizes equal to or smaller than A4 size.

Figure 11:
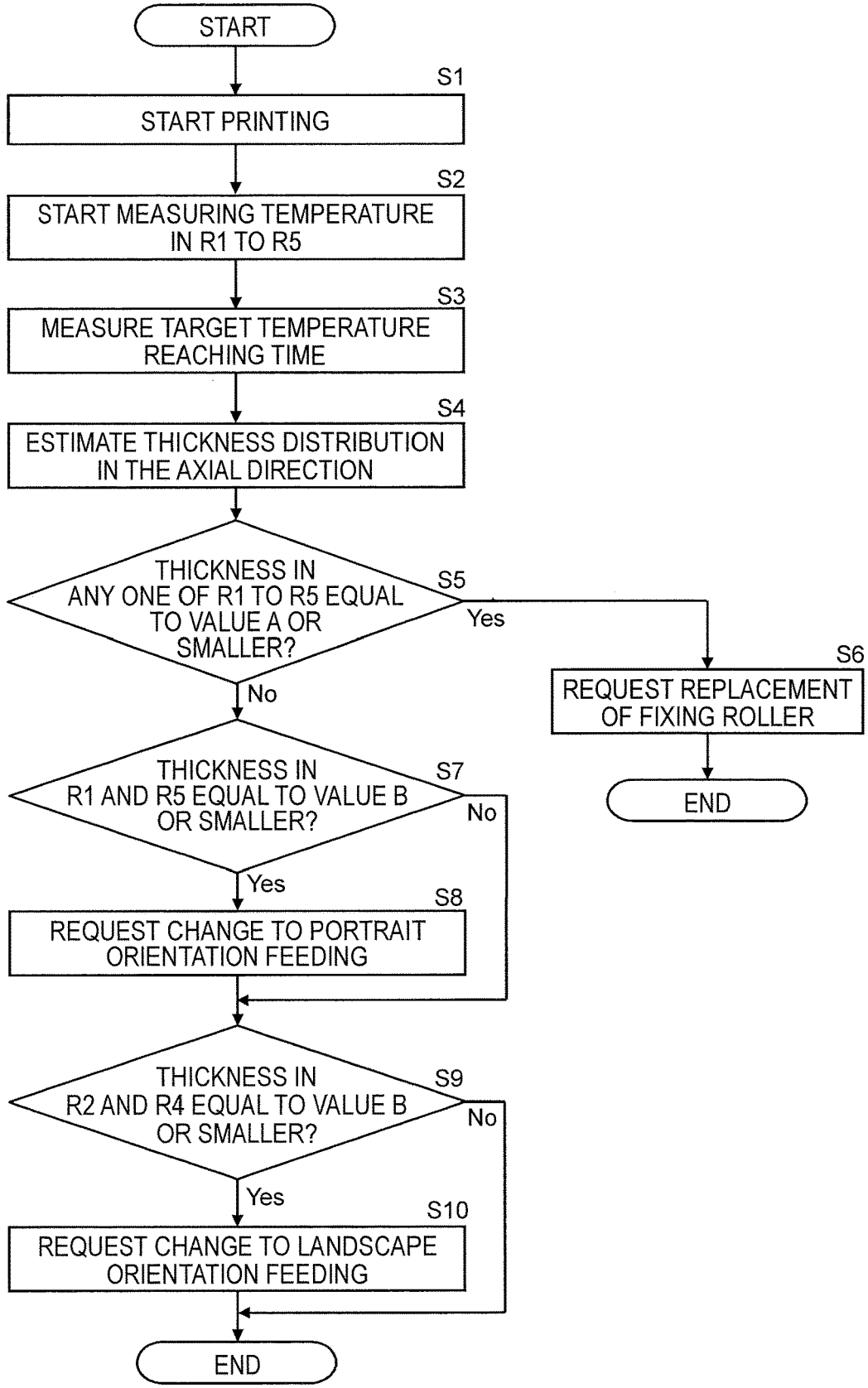
FIG. 11 is a flow chart showing a procedure for estimating the lifetime of the fixing roller and requesting the change of the sheet feed orientation in the image forming apparatus according to the embodiment.

FIG. 11 is a flow chart showing a procedure for estimating the lifetime of the fixing roller 21 and requesting the change of the sheet feed orientation in the image forming apparatus 100 according to this embodiment. With reference to FIGS. 1 to 10, a procedure for replacing the fixing roller 21 and changing the orientation of sheets will be described along the steps in FIG. 11.

When an instruction to start printing is fed in from a host device such as a personal computer (Step S1), the fixing roller pair 20 composed of the fixing roller 21 and the pressing roller 22 starts to be driven to rotate. Simultaneously, an electric current starts to be fed to the heater 26, and the first temperature sensor 33 starts to sense the surface temperature of the fixing roller 21.

Then, the control portion 90 makes the first temperature sensor 33 start measuring the surface temperature of the fixing roller 21 in the regions R1 to R5 (Step S2). Then, the target temperature reaching time taken to reach a target temperature (for example, a fixable temperature) is counted (Step S3). The control portion 90 estimates the thickness distribution of the coat layer 21*b* in the axial direction based on the counted target temperature reaching time and the correlation, stored in the RAM 93 (or the ROM 92), between the target temperature reaching time and the thickness of the coat layer 21*b* (Step S4).

The thickness distribution of the coat layer 21*b* in the axial direction at Steps S3 and S4 does not need to be estimated every time printing is performed, and it has only to be estimated with predetermined timing, for example, when the cumulative number of printed sheets counted after the previous estimation of the thickness distribution reaches a predetermined number (for example, 1 k) of sheets.

Then, the control portion 90 checks whether or not the thickness of the coat layer 21*b* in any one of the regions R1 to R5 is estimated to be equal to or smaller than a threshold value A (corresponding to the given value A in FIG. 9; for example 5 μm) (Step S5). If there is a region where the thickness of the coat layer 21*b* is equal to or smaller than the threshold value A (Yes in Step S5), according to a control signal from the control portion 90, a notification that prompts replacement of the fixing roller 21 is given on the liquid crystal display portion 71 (Step S6), and the procedure then ends.

On the other hand, if the thickness of the coat layer 21*b* is estimated to be larger than the threshold value A in all the regions R1 to R5 (No in Step S5), then, it is checked whether or not the thickness of the coat layer 21*b* in the regions R1 and R5 is estimated to be equal to or smaller than a threshold value B (B>A) (Step S7). If the thickness of the coat layer 21*b* in the regions R1 and R5 is estimated to be equal to or smaller than the threshold value B, according to a control signal from the control portion 90, a notification that prompts changing of the sheet feed orientation from landscape to portrait is given on the liquid crystal display portion 71 (Step S8).

If the thickness of the coat layer 21*b* in the regions R1 and R5 is estimated to be larger than the threshold value B (No in Step S7), then, it is checked whether or not the thickness of the coat layer 21*b* in the regions R2 and R4 is estimated to be equal to or smaller than the threshold value B (B>A) (Step S9). If the thickness of the coat layer 21*b* in the regions R2 and R4 is estimated to be equal to or smaller than the threshold value B, according to a control signal from the control portion 90, a notification that prompts changing of the sheet feed orientation from portrait to landscape is given on the liquid crystal display portion 71 (Step S10), and the procedure then ends.

Through the above-described control, by judging the time to replace the fixing roller 21 based on the thickness distribution of the coat layer 21*b* in the axial direction, it is possible to accurately determine the lifetime of the fixing roller 21. Thus, it is possible to reliably prevent image defects caused when the fixing roller 21 is not replaced despite its having reached the end of its useful life, and to prevent a situation in which the fixing roller 21 is replaced despite its not yet having reached the end of its useful life.

By changing the position at which an edge part of sheets S makes contact with the fixing roller 21 by switching the feed orientation of sheets S based on the thickness distribution of the coat layer 21*b* in the axial direction, it is possible to reduce local wear on the coat layer 21*b* and thus to prolong the lifetime of the fixing roller 21.

In the above-described control example, a notification that prompts replacement of the fixing roller 21 is given when the thickness of the coat layer 21*b* is estimated to be equal to or smaller than the threshold value A in any one of the regions R1 to R5; instead, a configuration may be adopted in which when the thickness of the coat layer 21*b* is estimated to be larger than the threshold value A, a cumulative number of printed sheets which will be observed when the thickness of the coat layer 21*b* becomes equal to or smaller than the threshold value A in any one of the regions R1 to R5 is estimated, and then when the estimated cumulative number of printed sheets is reached, a notification that prompts replacement of the fixing roller 21 is given.

Also another configuration may be adopted in which when a notification that prompts changing of the feed orientation of sheets S is given, a cumulative number of printed sheets which will be observed when the thickness of the coat layer 21*b* becomes equal to or smaller than the threshold value A is estimated, and then a notification is given on the number of sheets printable until the estimated cumulative number of printed sheets is reached.

The embodiments described above are in no way meant to limit the present disclosure, which thus allows for many modifications and variations within the spirit of the present disclosure. For example, while the above-mentioned embodiment deals with, as an example, the fixing device 15 adopting a heating roller fixing method where, to fix toner, a sheet carrying an unfixed toner image on it is passed through the fixing nip N formed between the fixing roller 21 and the pressing roller 22, the above-described embodiment is applicable also to a fixing device adopting a belt fixing method where an endless fixing belt provided in place of the fixing roller 21 so that, to fix toner, a sheet carrying an unfixed toner image on it is passed through a fixing nip formed between the fixing belt and a pressing member in pressed contact with the fixing belt.

While the above-described embodiment deals with an example in which the thickness distribution of the coat layer 21*b* of the fixing roller 21 is estimated with the first temperature sensor 33 provided to sense the surface temperature at a plurality of places on the fixing roller 21 in its axial direction, it is also possible to estimate, in a similar manner, the thickness distribution of a PFA tube 22*c* (the surface layer) of the pressing roller 22.

Figure 12:
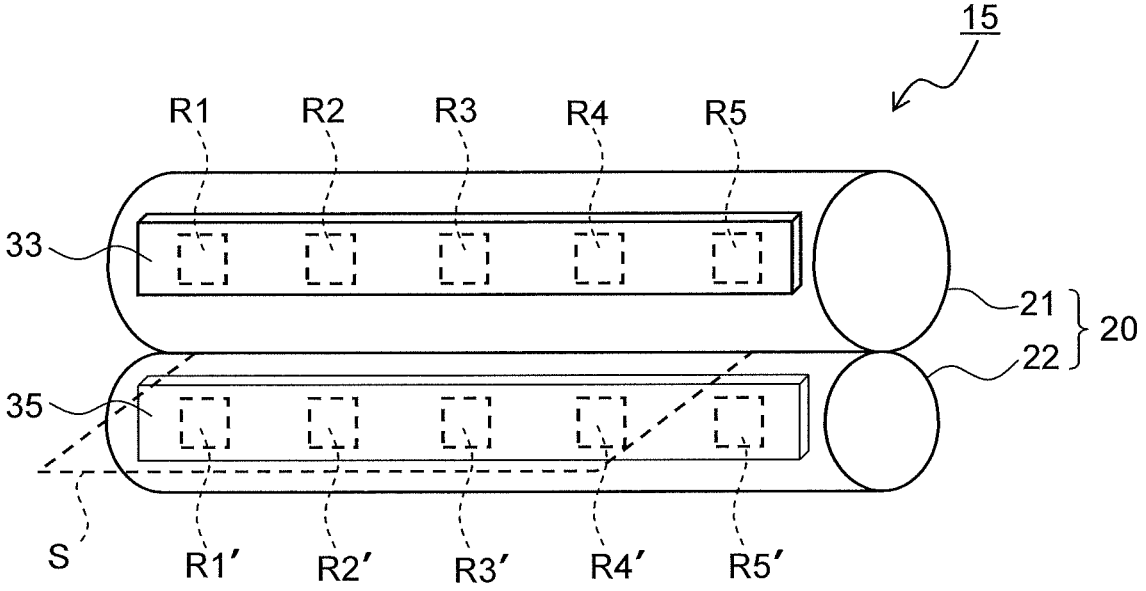
FIG. 12 is a perspective view of the fixing roller pair on which a second temperature sensor is arranged to sense the surface temperature of the pressing roller.

For example, as shown in FIG. 12, in addition to the first temperature sensor 33, a second temperature sensor 35 may be provided to sense the surface temperature of the pressing roller 22 at a plurality of places (the regions R1' to R5') in the axial direction so that the lifetime of the fixing roller 21 and the pressing roller 22 may be estimated by estimating the thickness distribution of both the coat layer 21*b* of the fixing roller 21 and the PFA tube 22*c* of the pressing roller 22.

Needless to say, the present disclosure is applicable, not only to monochrome printers like the one shown in FIG. 1, but also to other types of image forming apparatuses incorporating a fixing device, such as color printers, monochrome and color copiers, digital multifunction peripherals, facsimile machines, and the like.

The present disclosure finds application in fixing devices provided with a fixing member such as a fixing roller or a pressing roller. Based on the present disclosure, it is possible to provide a fixing device that can accurately estimate the worn state of a fixing member in its axial direction with a simple method, and to provide an image forming apparatus provided with such a fixing device.

What is claimed is:

1. An image forming apparatus comprising:

an image forming portion which forms a toner image on a recording medium;

a fixing device having a fixing member including:

a heated rotary member arranged downstream of the image forming portion in a conveyance direction of the recording medium, the heated rotary member being heated by a heating device; and a pressing member which forms a fixing nip by making contact with the heated rotary member, the fixing device heating and pressing the recording medium passing through the fixing nip and thereby fixing the toner image to the recording medium;

a temperature sensing device which is capable of sensing a surface temperature of at least one of the heated rotary member and the pressing member in a plurality of regions in an axial direction thereof; and a control portion which estimates thickness distribution of a surface layer of at least one of the heated rotary member and the pressing member in the axial direction based on a target temperature reaching time taken for the surface temperature in the plurality of regions to reach a predetermined temperature after the heating device starts heating without the recording medium passing through the fixing nip and which thereby estimates a lifetime of at least one of the heated rotary member and the pressing member based on the estimated thickness distribution.

2. An image forming apparatus of claim 1, further comprising:

a notification device capable of notifying the lifetime of at least one of the heated rotary member and the pressing member estimated based on the thickness distribution, wherein the control portion, by use of the notification device, gives a notification that prompts replacement of the heated rotary member or the pressing member when a thickness of the surface layer in any one of the plurality of regions is estimated to be equal to or smaller than a threshold value A.

3. An image forming apparatus of claim 2, wherein when the thickness of the surface layer is estimated to be larger than the threshold value A in all the plurality of regions, the control portion estimates a cumulative number of printed sheets which will be observed when the thickness of the surface layer in any one of the plurality of regions becomes equal to or smaller than the threshold value A, and, by use of the notification device, gives a notification that prompts replacement of the heated rotary member or the pressing member when the estimated cumulative number of printed sheets is reached.

4. The image forming apparatus of claim 2, wherein when the thickness of the surface layer in any one of the plurality of regions is estimated to be equal to or smaller than a threshold value B (B>A), the control portion, by use of the notification device, gives a notification that prompts changing of a feed orientation of the recording medium passing through the fixing nip to another orientation to avoid an edge part of the recording medium passing through the region in which the thickness of the surface layer is estimated to be equal to or smaller than the threshold value B.

5. The image forming apparatus of claim 1, wherein the temperature sensing device senses the surface temperature of at least one of the heated rotary member and the pressing member in the plurality of regions in the axial direction, always at a same position in a circumferential direction.

* * * * *